US008177590B2

(12) United States Patent
Tanaka et al.

(10) Patent No.: US 8,177,590 B2
(45) Date of Patent: May 15, 2012

(54) CRIMPING TERMINAL AND METHOD OF MANUFACTURING TERMINAL-PROVIDED WIRE

(75) Inventors: Tetsuji Tanaka, Yokkaichi (JP); Hiroki Hirai, Yokkaichi (JP); Junichi Ono, Yokkaichi (JP); Takuji Otsuka, Yokkaichi (JP); Hiroki Shimoda, Yokkaichi (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 12/937,416

(22) PCT Filed: Apr. 24, 2009

(86) PCT No.: PCT/JP2009/058200

§ 371 (c)(1), (2), (4) Date: Oct. 12, 2010

(87) PCT Pub. No.: WO2009/136560

PCT Pub. Date: Nov. 12, 2009

(65) Prior Publication Data

US 2011/0028054 A1 Feb. 3, 2011

(30) Foreign Application Priority Data

May 7, 2008 (JP) ..... 2008-121458

(51) Int. Cl.
*H01R 4/10* (2006.01)

(52) U.S. Cl. ..... 439/877

(58) Field of Classification Search ..... 439/877, 439/878, 595
See application file for complete search history.

(56) References Cited

U.S. PATENT DOCUMENTS

| | | | | |
|---|---|---|---|---|
| 2,870,239 | A * | 1/1959 | Ustin | 439/843 |
| 3,496,520 | A * | 2/1970 | Reynolds | 439/442 |
| 3,539,976 | A * | 11/1970 | Reynolds | 439/585 |
| 3,594,702 | A * | 7/1971 | Frey | 439/442 |
| 3,633,156 | A * | 1/1972 | Teagno et al. | 439/850 |
| 3,670,293 | A * | 6/1972 | Garver | 439/585 |
| 3,892,459 | A * | 7/1975 | Dittmann et al. | 439/442 |

(Continued)

FOREIGN PATENT DOCUMENTS

JP A-2000-21464 1/2000

(Continued)

OTHER PUBLICATIONS

International Search Report for International Patent Application No. PCT/JP2009/058200, mailed on May 26, 2009.

*Primary Examiner* — Briggitte R Hammond
(74) *Attorney, Agent, or Firm* — Oliff & Berridge, PLC

(57) ABSTRACT

A crimp terminal whose crimp state can be easily evaluated and to provide a method of manufacturing a terminal-provided wire comprising the crimp terminal. The crimp terminal includes a pair of conductor barrels which are crimped onto a conductor of an electric wire. The conductor barrel has an outer surface provided with a crimp state indicator for evaluating a crimp level thereof. The indicator may be a mark so shaped that a position of an internal end of an outwardly exposed part thereof is varied in a terminal axial direction corresponding to the crimp level, or include a plurality of marks spaced in a direction perpendicular to the terminal axial direction.

10 Claims, 11 Drawing Sheets

U.S. PATENT DOCUMENTS

| | | | | |
|---|---|---|---|---|
| 3,990,143 | A * | 11/1976 | Dittmann et al. | 29/865 |
| 4,142,771 | A * | 3/1979 | Barnes et al. | 439/442 |
| 4,692,122 | A * | 9/1987 | Montalbano | 439/882 |
| 6,056,605 | A * | 5/2000 | Nguyen et al. | 439/882 |
| 6,626,711 | B2 * | 9/2003 | Kitagawa et al. | 439/877 |
| 6,676,458 | B2 * | 1/2004 | Kuwayama et al. | 439/877 |
| 6,951,483 | B2 * | 10/2005 | Kameyama | 439/595 |
| 7,494,388 | B2 * | 2/2009 | Kakuta | 439/877 |
| 8,070,536 | B2 * | 12/2011 | Ono et al. | 439/877 |
| 2002/0022414 | A1 | 2/2002 | Kitagawa et al. | |
| 2004/0003498 | A1 * | 1/2004 | Swearingen et al. | 439/677 |
| 2005/0164566 | A1 * | 7/2005 | Zhao et al. | 439/851 |
| 2007/0134980 | A1 * | 6/2007 | Poll et al. | 439/585 |
| 2010/0144217 | A1 * | 6/2010 | Kumakura et al. | 439/877 |
| 2010/0261391 | A1 * | 10/2010 | Ono et al. | 439/877 |
| 2011/0165801 | A1 * | 7/2011 | Kuwayama et al. | 439/882 |

FOREIGN PATENT DOCUMENTS

| | | |
|---|---|---|
| JP | A-2001-357901 | 12/2001 |

* cited by examiner

CRIMPING TERMINAL AND METHOD OF MANUFACTURING TERMINAL-PROVIDED WIRE

BACKGROUND OF THE INVENTION

1. Field of the Invention

The present invention relates to a crimp terminal adapted to be crimped onto an end of an electric wire provided for an automobile or the like, and a method of manufacturing a terminal-provided wire including the crimp terminal.

2. Description of the Related Art

Conventionally crimping is often used to attach a terminal to an end of an insulated cable. The crimping is performed by caulking a conductor barrel formed in advance on the terminal to the end of a conductor of the insulated cable using a die (described in Patent Document 1, for example).

FIGS. 11 and 12 show a structure of a terminal-provided wire having a conventionally typical crimp terminal. The terminal-provided wire has an electric wire 20 and a crimp terminal 10 crimped onto an end of the electric wire 20.

The wire 20 is made of a conductor 22 and an insulation cover 24 covering the conductor 22 radially, the insulation cover 24 partially emitted at the end of the electric wire 20 to expose the conductor 22.

The crimp terminal 10 has an electrical connection portion 12 and a crimped portion in front and rear. The electrical connection portion 12 is a female type shaped in a box into which a not shown male type terminal can be fitted. The crimped portion includes a bottom wall 14 which is a basal portion reward in an axial direction from the electrical connection portion 12, a pair of right and left conductor barrels 16 each extending perpendicular to the axial direction from the bottom wall 14, and a pair of right and left barrels 18 each extending parallel to the conductor barrels 16. Both of the conductor barrels 16 and the insulation barrels 18 are approximately U-shaped in an axial view before bending.

For crimp of the crimp terminal 10, the end of the electric wire 20 is set onto the bottom wall 14 and, in this state, each of the conductor barrels 16 and each of the insulation barrels 18 are inwardly bent by pressing with dyes. Both of the conductor barrels 16 are thereby crimped onto the conductor 22 exposed at the end of the electric wire 20 so as to embrace the conductor 22. In the same manner, both of insulation barrels 18 are so crimped onto the insulation cover 24 at a position adjacent to the conductor 22 as to embrace the insulation cover 24 from both sides thereof.

To ensure a favorable electrical connection in this terminal-provided wire, there is required an evaluation of the quality of the crimp of the conductor barrels 16 onto the conductor 22 in an inspection on the electric wire; however, the crimp state, especially the crimp level of the conductor barrels 16 onto the conductor 22 (that is, a biting depth) cannot be easily evaluated based on its appearance. In addition, a radial reduction in the electric wire 20 and a size reduction in the crimp terminal 10 make the evaluation more difficult.

The Patent Document 1 discloses indication grooves formed in an outer surface of conductor barrels corresponding to a serration formed in an inner surface of the conductor barrels, the barrels calibrated between the grooves; however, the grooves and the calibration cannot indicate a crimp level of the conductor barrels. The grooves etc., formed in shapes extending perpendicular to the terminal axial direction (that is, longitudinally of the conductor barrel), cannot teach the crimp level of the conductor barrels onto the conductor (that is, a biting depth).

Patent Document 1: Japanese Patent Application Publication No. 2001-357901

SUMMARY OF THE INVENTION

Thus, an object of the present invention is to provide a crimp terminal having conductor barrels to be crimped onto a conductor at an end of an electric wire and allowing a quality of the crimp of the conductor barrels onto the conductor, especially a level of the crimp, to be easily evaluated, and to provide a method of manufacturing a terminal-provided wire comprising the crimp terminal. To achieve this object, the crimp terminal according to the present invention has a conductor crimp portion adapted to be crimped onto an end of an electric wire having a conductor exposed in the end, the conductor crimp portion including a basal portion extending in a terminal axial direction of the crimp terminal and a pair of conductor barrels extending oppositely in directions perpendicular to the terminal axial direction and being adapted to be bent to be so crimped onto the conductor as to embrace the conductor, each of the conductor barrels having an outer surface provided with a crimp state indicator so shaped that a position of an internal end of an outwardly exposed part of the crimp state indicator is varied in the terminal axial direction corresponding to a crimp level of the conductor barrels.

As to the conductor barrels, "extending oppositely in directions perpendicular to the terminal axial direction" is not intended to distinctly limit the specific shapes and the longitudinal direction of the conductor barrels, but intended to include ones whose longitudinal direction is inclined to some extent relative to the direction perpendicular to the terminal axial direction or ones whose axial size is larger than the size in the direction perpendicular to the terminal axial direction.

Besides, as to the crimp state indicator, "an internal end of an outwardly exposed part" means the most internal point in the exposed part, that is, the point closest to the other conductor barrel.

The present invention provides also a method of manufacturing a terminal-provided wire having an electric wire including a conductor exposed in an end thereof and a crimp terminal crimped onto the end, the method including: a step of forming the crimp terminal described above; a crimping step of bending the conductor barrels of the formed crimp terminal to crimp the conductor barrels onto the conductor from outside in the end of the electric wire; and a step of evaluating a quality of the crimp in the terminal-provided wire based on a position of an internal end of the crimp state indicator, on the conductor barrel, exposed following the crimping.

The present invention further provides a method of manufacturing a terminal-provided wire having an electric wire including a conductor exposed in an end thereof and a crimp terminal crimped onto the end, the method including: a step of forming a crimp terminal provided with a crimp state indicator including a plurality of marks; a crimping step of bending the conductor barrels of the formed crimp terminal to crimp the conductor barrels onto the conductor from outside in the end of the electric wire; and a step of evaluating a quality of the crimp in the terminal-provided wire based on the number of the marks, on the conductor barrel, exposed following the crimping and respective positions of the marks.

The present invention described above has the effect of enabling the crimp state of the conductor barrels, especially the crimp level thereof, to be easily evaluated based on the position of the internal end of the crimp state indicator exposed on the outer surface of the conductor barrels following the crimp thereof, or the positions in terms of the direction perpendicular to the terminal axial direction and the number of the marks included in the indicator.

DESCRIPTION OF EMBODIMENTS OF THE INVENTION

Figure 1:
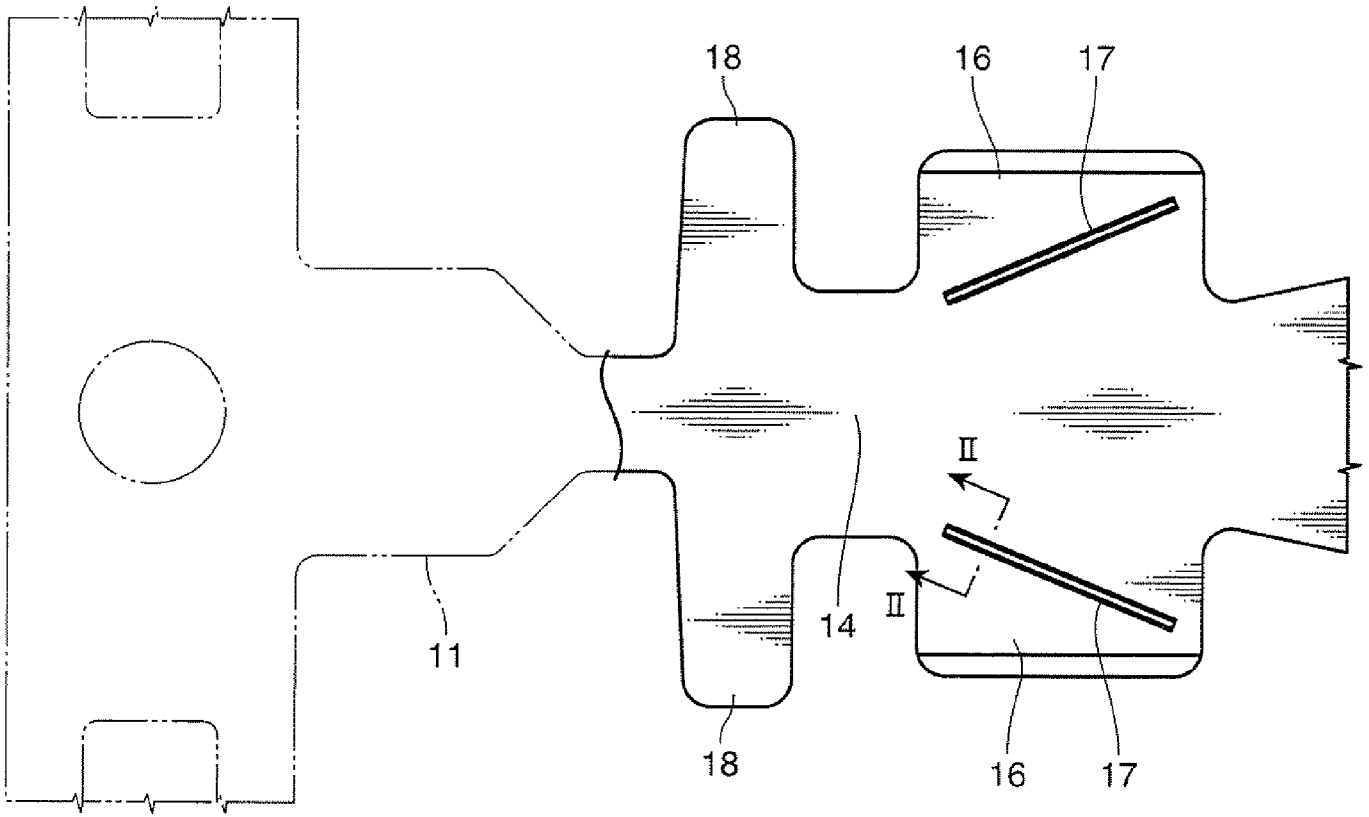
FIG. 1 is a development view of a crimp terminal according to a first embodiment of the present invention.

Preferred embodiments of the present invention will be described below with reference to FIG. 1 to FIG. 10. Each of the following embodiments includes a crimp terminal 10, and a basic configuration of the crimp terminal 10 and a configuration of the electric wire onto which the crimp terminal 10 is crimped are same as ones shown in FIG. 11 and FIG. 12 described above; thus, their description will be omitted by assigning thereto common reference numerals with FIGS. 11 and 12, and the following description will be made primarily about a feature of the crimping terminal 10 according to each of the embodiments.

FIG. 1 shows a part, corresponding to an electric wire crimp portion, of an original plate of a crimp terminal according to a first embodiment of the present invention. The original plate is stamped together with other original plates (having a same shape) and a carrier 11 connecting the original plates, from a single metal plate.

Figure 11:
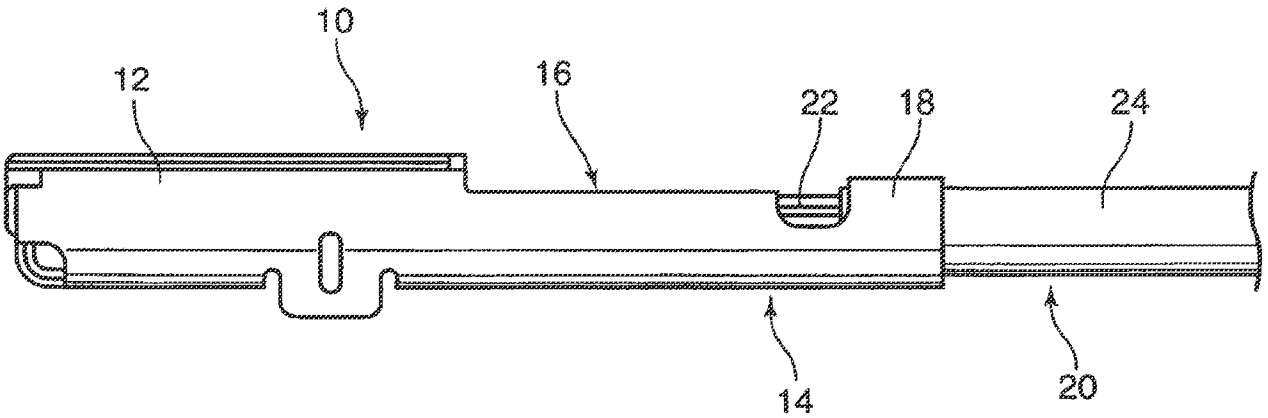
FIG. 11 Prior Art
FIG. 11 is a side view showing a configuration of a conventional crimp terminal.
Figure 12:
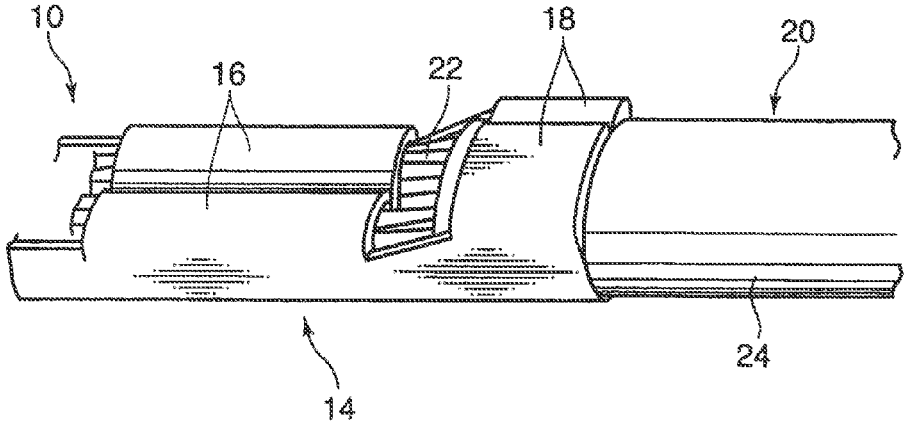
FIG. 12 Prior Art
FIG. 12 is a perspective view showing a crimped state of the crimp terminal illustrated in FIG. 11.

Each of the original plates includes a first portion constituting a electrical contact portion shown in FIG. 11 and FIG. 12 (that is, a portion adapted to fit with a counterpart terminal; it may also be a female type) and a second portion constituting an electric wire crimp portion. The second portion includes a bottom wall 14 which is a basal portion extending in a terminal axial direction (a right to left direction in FIG. 1), a pair of conductor barrels 16 extending from the bottom wall 14 in opposite directions perpendicular to the terminal axial direction, and a pair of insulation barrels 18 extending from the bottom wall 14 in opposite directions perpendicular to the terminal axial direction, behind the conductor barrels 16. The crimp terminal is manufactured by a method including a step of forming the electrical contact portion by bending the first portion, a step of forming the conductor barrels 16 and the insulation barrels 18 by bending the second portion, and a step of cutting off a portion immediately behind the insulation barrels 18 from the carrier 11.

According to a feature of the crimp terminal, each of the conductor barrels 16 has an outer surface provided with a crimp state indicator. Each of the crimp state indicator is provided to determine a failure/no-failure of the crimp (especially a level of the crimp) following the crimp of the conductor barrel 16 onto the conductor 22 in the end of the electric wire 20 shown in FIG. 11 and FIG. 12.

Each of the crimp state indicators according to the first embodiment is formed of a line-shaped mark 17. In this first embodiment, each of the line-shaped marks 17 is shaped in a straight line inclined with respect to the axial direction of the crimping terminal (in FIG. 1, the rightward-leftward direction) in such a manner as to direct outwardly in a direction perpendicular to the axial direction, toward a front end of the crimping terminal (i.e., toward a front edge of a corresponding one of the conductor barrels 16).

Figure 2:
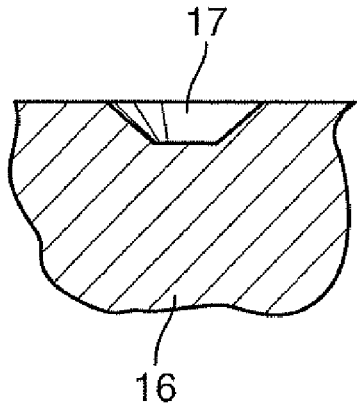
FIG. 2 is a sectional view taken along the line II-IT in FIG. 1.

The line-shaped marks 17 can be formed of grooves depressed in the outer surface of the conductor barrel 16 as shown in FIG. 2 for example, and the grooves can be efficiently formed together with the stamp of the original plate. However, the line-shaped mark 17 is not limited to one formed of a groove but may be printed on the outer surface of the conductor barrel 16. This is similarly adapted to the crimp state indicators according to the following other embodiments. Besides, the lined-mark 17 may be reversely inclined, that is, may be so inclined as to direct inwardly toward the tip end of the terminal.

The formed crimp terminal can contribute to a provision of high-quality terminal-provided wires through the following crimping step and inspection step.

1) Crimping Step

In this step, the end of the electric wire 20 is set on the bottom wall 14 of the crimp terminal, and, in this state, the conductor barrel 16 and the insulation barrel 18 are caulked, for example, by a normal die table and a normal die (that is, are bent) similarly to the conventional crimp terminal; thus the barrels 16 and 18 are crimped onto the conductor 22 on the end of the electric wire 20 and the insulation covering 24 directly to the rear thereof, respectively. More specifically, the barrels 16 and 18 are so bent as to embrace the conductor 22 and the insulation covering 24 respectively.

The conductor 22 is not especially limited to its material: it may be made of not only cupper or cupper alloy but also aluminum or aluminum alloy. Particularly to the latter case, where a high compressing crimp is required for breaking the oxide film formed in the surface of the conductor 22, the present invention can be effectively adapted. This is similarly true for the following other embodiments.

2) Inspection Step

In this inspection step, a failure/no-failure of the crimp of the conductor barrels 16 is determined to assure the electrical connection of the crimp terminal and the conductor 22. The failure/no-failure can be easily determined by checking on the shape of each of the line-shaped mark 17 forming the crimp state indicator, especially the position of the line-shaped mark 17 in terms of the terminal axial direction at the internal end of both of the crimped conductor barrels 16.

Figure 3:
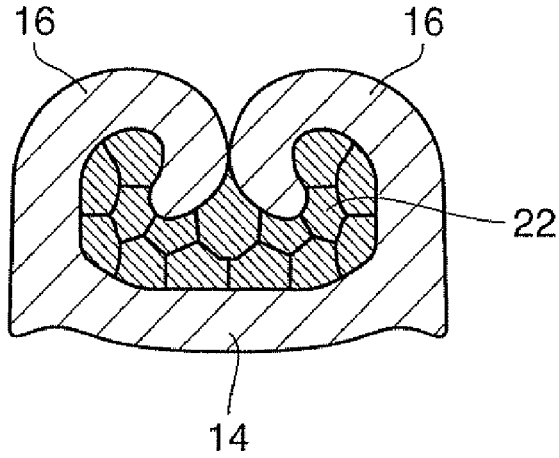
FIG. 3 is a sectional view showing a state after the crimp terminal is well crimped.
Figure 4:
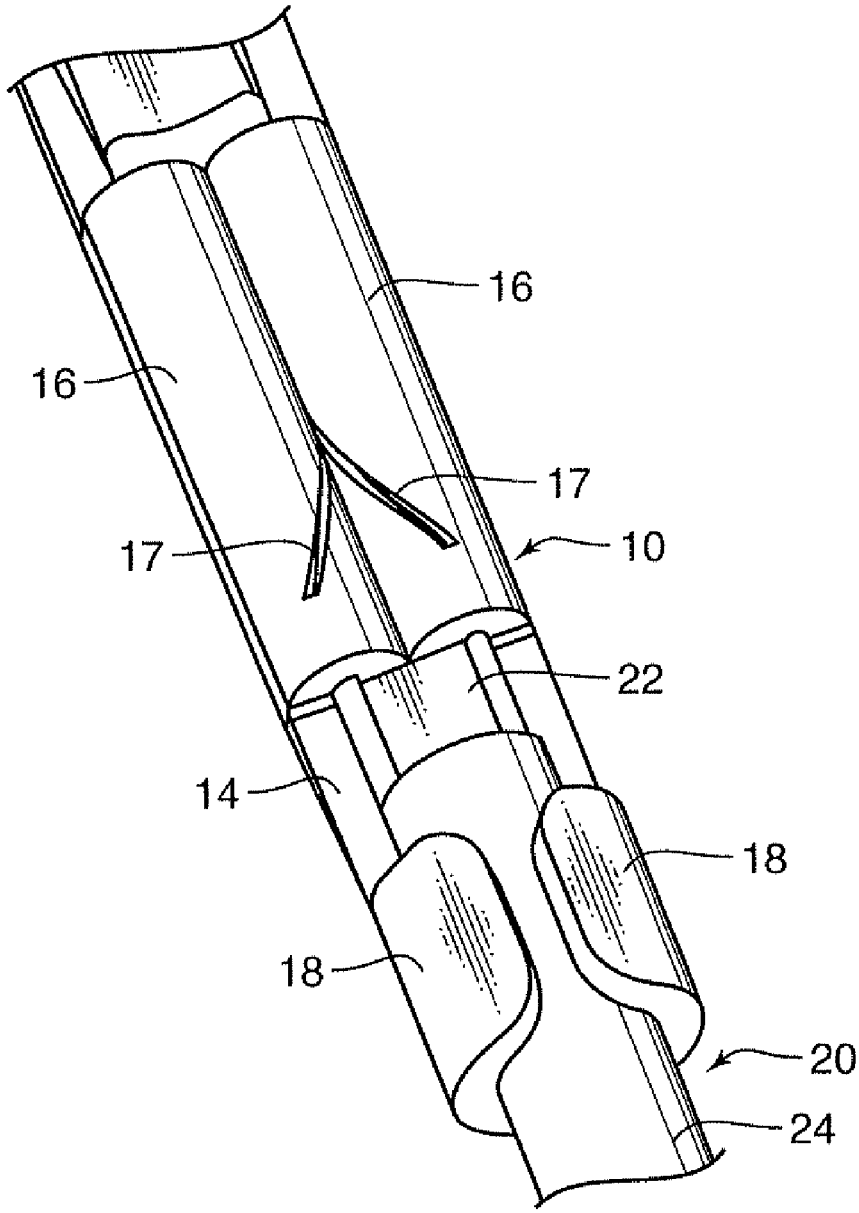
FIG. 4 is a perspective view showing an appearance of the crimp terminal in the crimped state illustrated in FIG. 3.

FIG. 3 shows a section in a favorite crimp state of the conductor barrels 16 and FIG. 4 shows an appearance of the conductor barrels 16 in the same state. In the state where both of the conductor barrels 16 satisfactorily bite into the conductor 22 (formed of a plurality of element wires, in FIG. 3), the positions of the line-shaped marks 17 at the internal end of both of the conductor barrels 16 are sufficiently shifted back toward the insulation barrels 18 as shown in FIG. 4.

On contrary, when at least one of the conductor barrels 16 fails to be crimped as shown in the sectional views of FIGS. 5A to 5D, the position of the line-shaped mark 17 at the internal end of the failing conductor barrel 16 will be shifted from the position shown in FIG. 4. This shift makes it possible to easily evaluate the failure/no-failure of the crimp level of the conductor barrel 16.

Figure 5A:
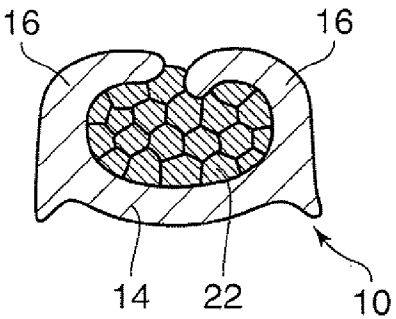
FIGS. 5A to 5D are sectional views each showing a state after the crimp terminal is inadequately crimped.
Figure 5B:
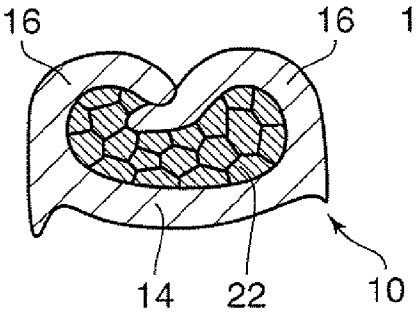
Figure 5C:
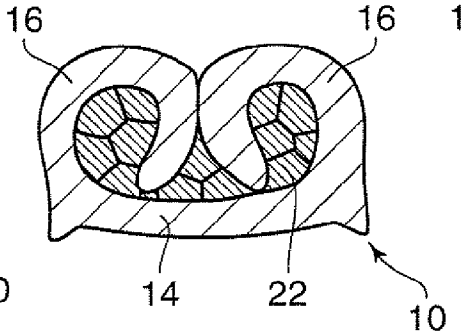
Figure 5D:
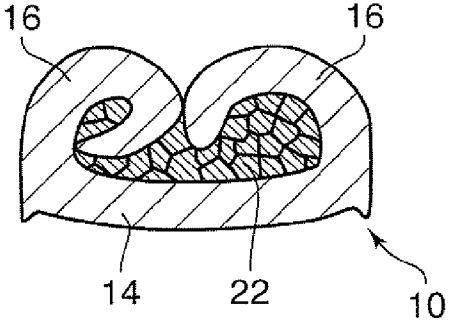
Figure 6:
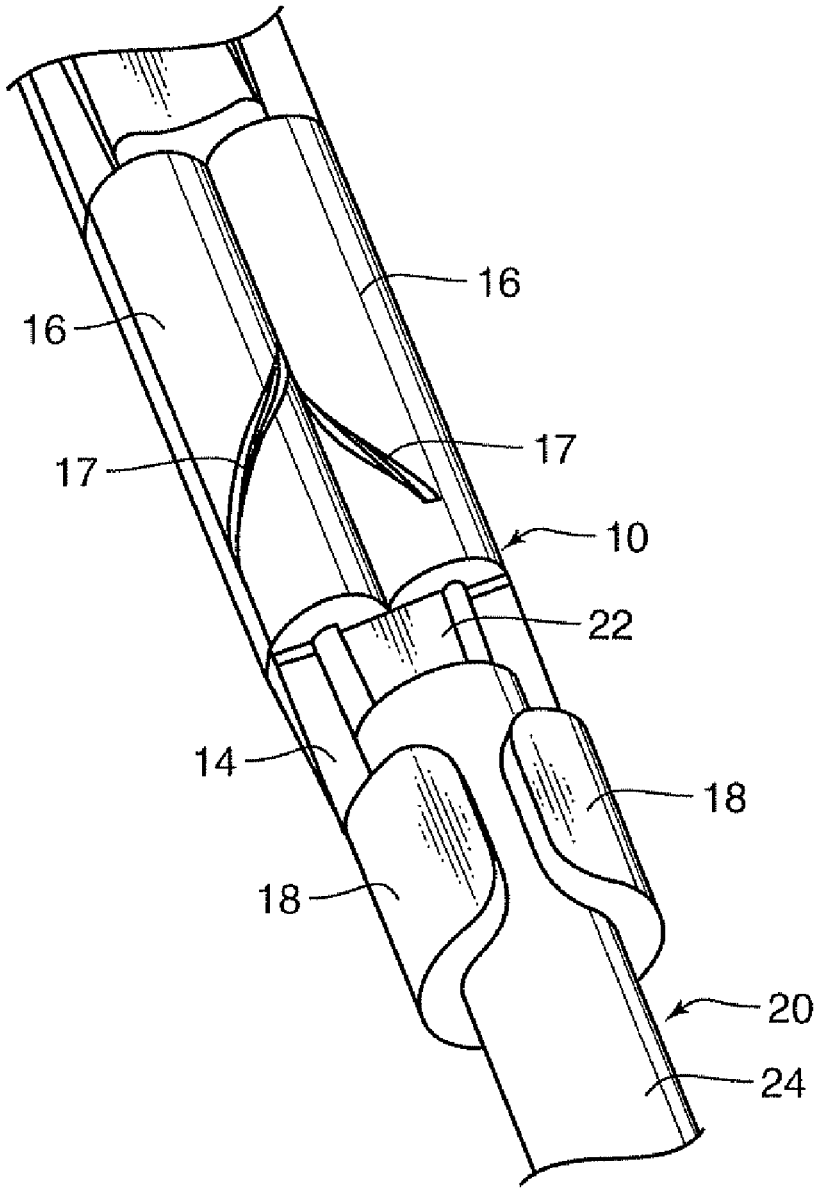
FIG. 6 is a perspective view showing an appearance of the crimp terminal in the crimped state illustrated in FIG. 5B.

Specifically, when the crimp of either of the conductor barrels 16 is in an excessive low degree as shown in FIG. 5A, or when the crimp of only one of the conductor barrels 16 is in an excessive low degree as shown in FIG. 5B, the position of the line-shaped mark 17 at the internal end of the low crimped conductor barrel 16 is forwardly shifted from the position shown in FIG. 4. On contrary, when both of the conductor barrels 16 bits excessively to touch the bottom wall 14 as shown in FIG. 5C, or when one of the conductor barrels 16 is too curled to touch the basal portion of the conductor barrel 16 itself as shown in FIG. 5D, the position of the line-shaped mark 17 at the internal end of the excessively high crimped conductor barrel 16 is further rearwardly shifted from the position to the side of the insulation barrels 18 shown in FIG. 4.

Especially, a pair of marks of symmetrical shapes about the terminal center axis, such as line-shaped marks 17 shown in FIG. 1, has an advantage of being capable of markedly indicating an failure/no-failure of the balance of the crimp levels of both of the conductor barrels 16. For example, unbalanced crimp levels of the conductor barrels 16 as shown in FIG. 5B gives a great axial difference between the positions of the line-shaped marks 17 at the internal ends of the conductor barrels 16, that is, at the positions where the conductor barrels 16 are closest to each other or mutually touch. Based on the degree of the position difference, a failure/no-failure of the crimp level balance can be easily evaluated.

The line-shaped marks 17 also facilitates a check of an external protrusion of the conductor 22 from between the conductor barrels 16, as a sub effect. For example, when the biting of the conductor barrels 16 are so shallow that the element wire forming the conductor 22 externally protrudes through between the conductor barrels 16 as shown in FIG. 5A, the protrusion cannot be easily checked if the colors of the surface of the element wire and the surface of the conductor barrels 16. However, the line-shaped marks 17 provided on the conductor barrels 16 help the identification of the conductor barrels 16 and the element wire.

Accordingly, the above-mentioned crimp terminal eventually allows only high-quality terminal-provided wires to be provided to the market.

Figure 7:
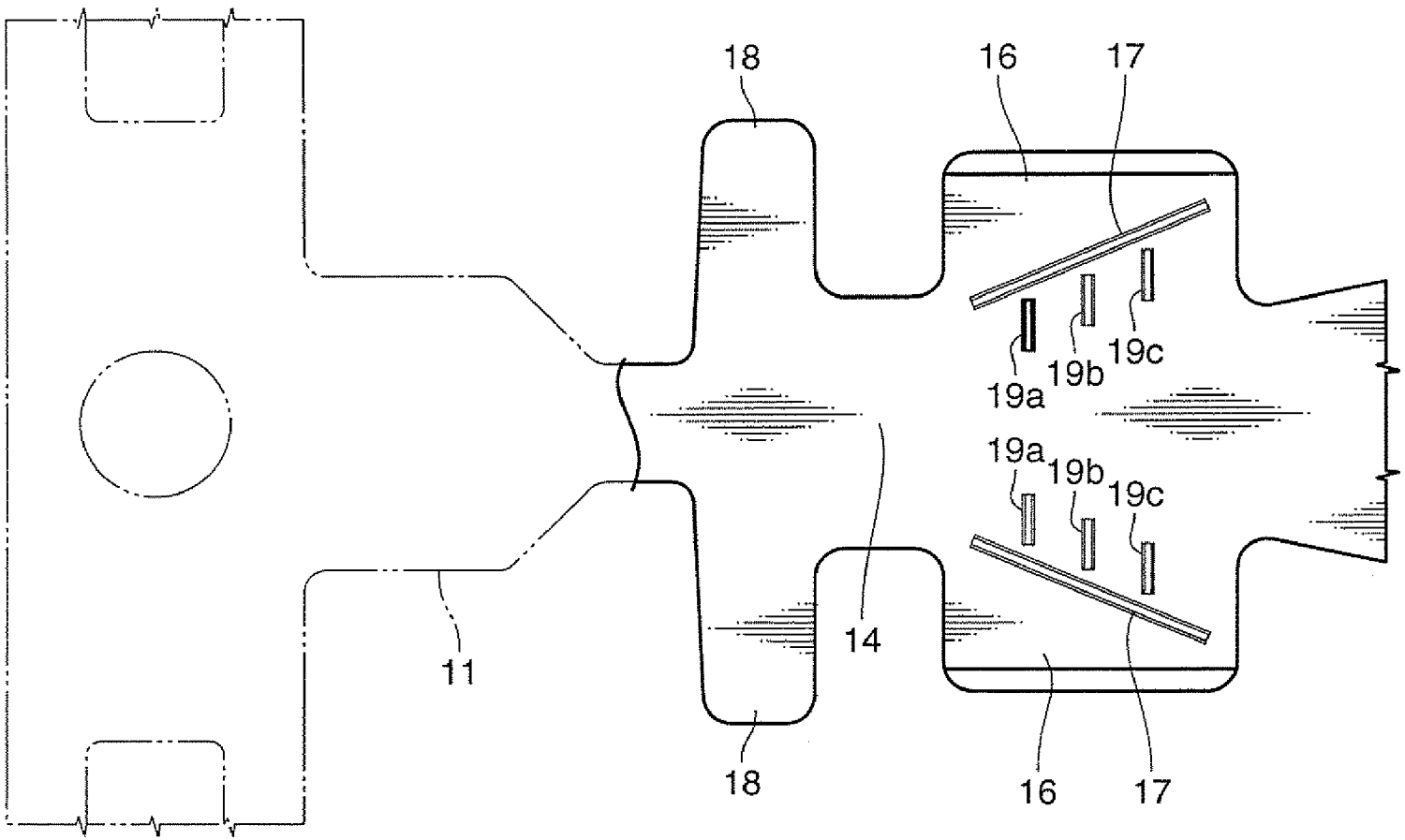
FIG. 7 is a development view of a crimp terminal according to a second embodiment of the present invention.

Furthermore, in a crimp terminal shown in FIG. 7 as to a second embodiment, in addition to the line-shaped marks 17, provided are calibration marks 19*a*, 19*b* and 19*c* spaced in a direction parallel to the terminal axial direction, near the line-shaped marks 17. These calibration marks 19*a*, 19*b* and 19*c* make it easier to check the positions of the line-shaped marks 17 at the internal end of the conductor barrels 16.

Figure 8:
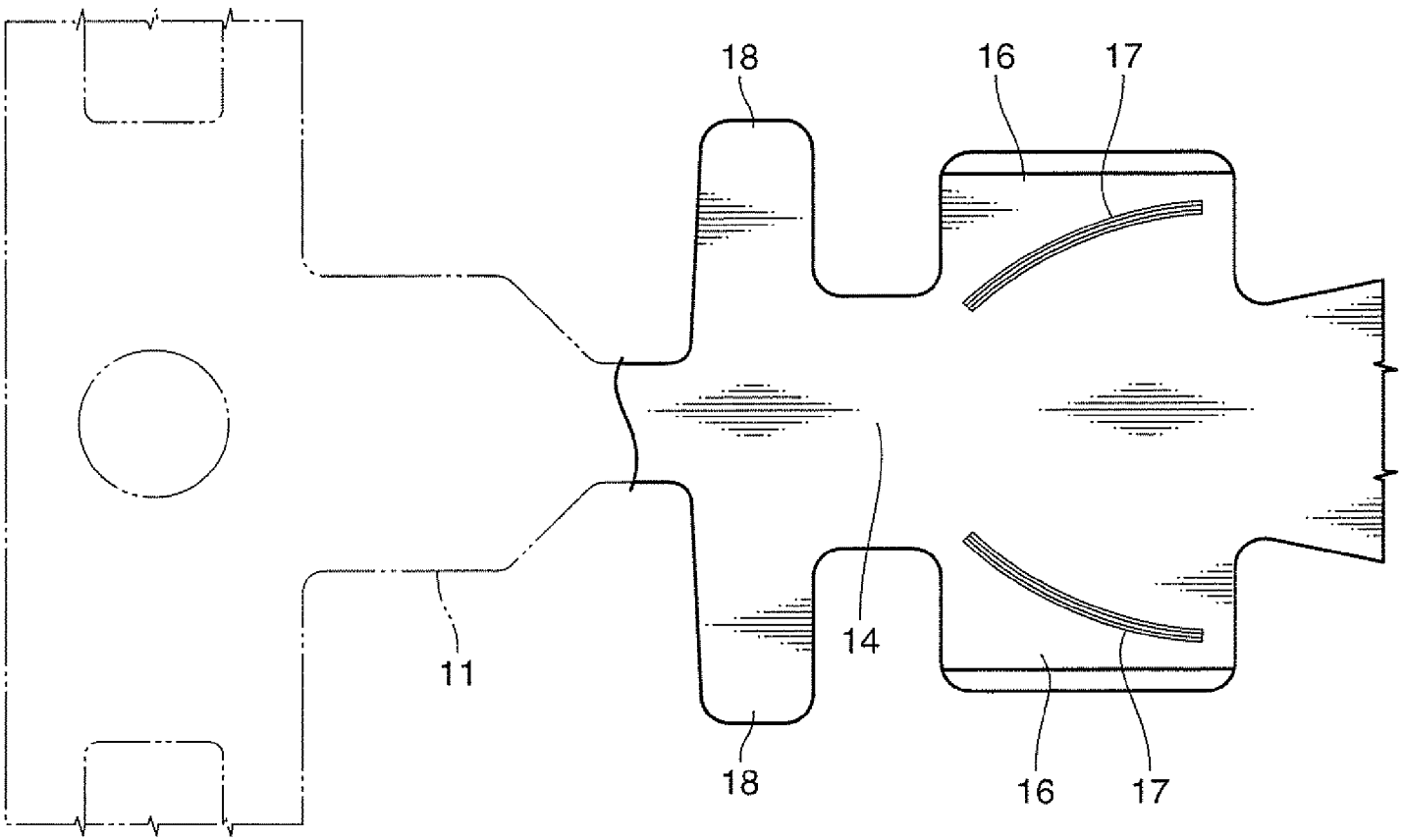
FIG. 8 is a development view of a crimp terminal according to a third embodiment of the present invention.
Figure 9:
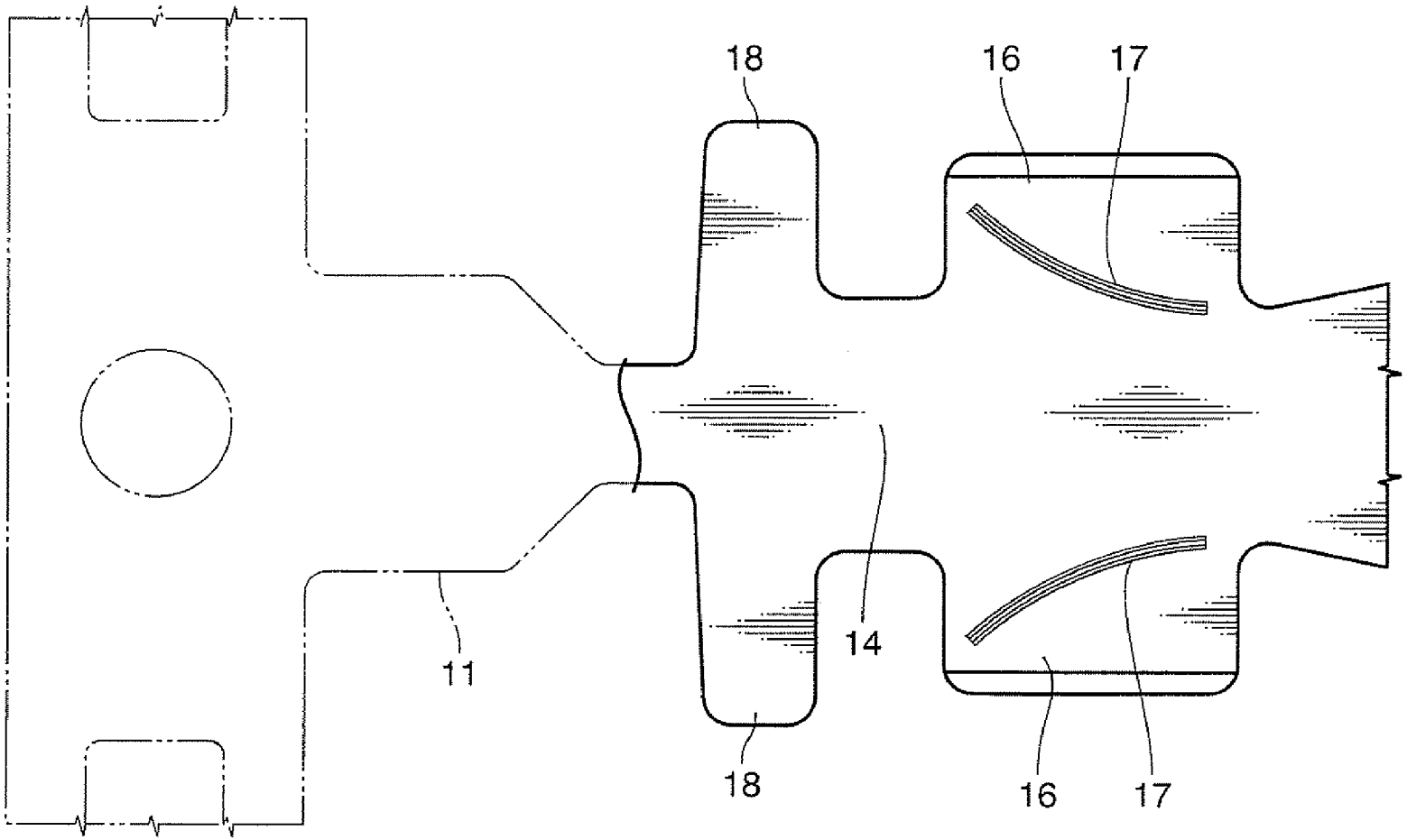
FIG. 9 is a development view of a crimp terminal according to a fourth embodiment of the present invention.

Each of the line-shaped marks 17 is not limited to a straight line, but allowed to be curved inwardly or outwardly as shown in FIG. 8 and FIG. 9 as a third embodiment and a fourth embodiment respectively, or be a combination of a straight line and a curved line. The line-shaped mark 17 shown in FIG. 8, having a shape whose inclination to the terminal axial direction is increased as its position is far from the conductor barrels 16, is suitable especially in the case that an criterion of judgment is set in a relatively high area (that is, in the case that a relatively high compression is required). On contrary, the line-shaped mark 17 shown in FIG. 9, having a shape whose inclination to the terminal axial direction is increased as its position is close to the conductor barrels 16, is suitable especially in the case that an criterion of judgment is set in a relatively low area (that is, in the case that a relatively low compression is required). These are true also in the case of a line-shaped mark each formed of a plurality of straight lines to be curved as a whole.

Figure 10:
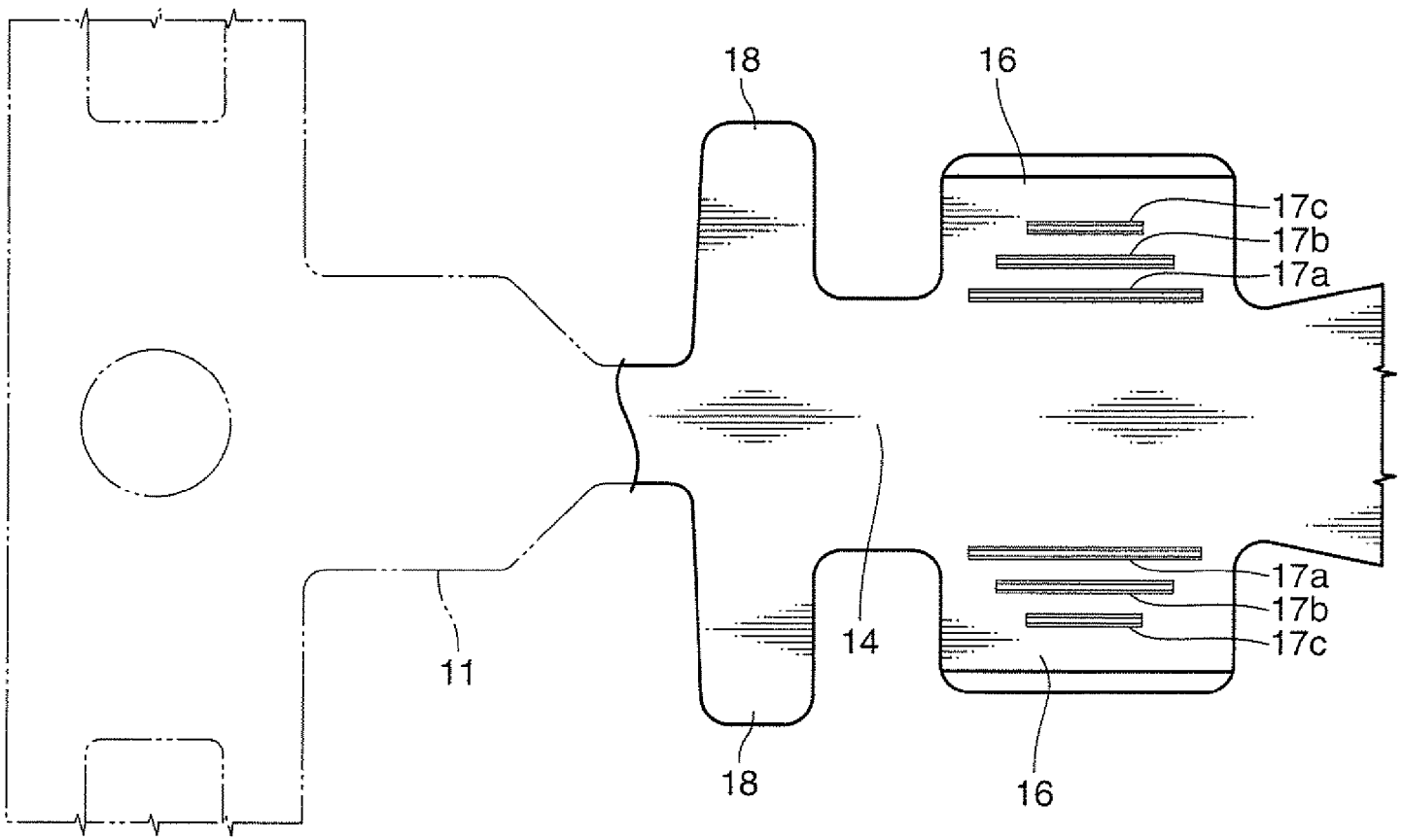
FIG. 10 is a development view of a crimp terminal according to a fifth embodiment of the present invention.

There is shown a fifth embodiment according to the present invention in FIG. 10. Also this embodiment includes a crimp state indicator provided in an outer surface of each of the conductor barrels 16; however, the crimp state indicator is formed of a plurality of (three, in FIG. 10) line-shaped marks 17*a*, 17*b* and 17*c*. The line-shaped marks 17*a*, 17*b* and 17*c*, each extending in a direction parallel to the terminal axial direction, are spaced, in this order from the side of the basal end (the side adjacent to the bottom wall 14) of the conductor barrel 16, in a direction perpendicular to the terminal axial direction.

In the crimp terminal according to this embodiment, since the crimp level of the conductor barrel 16 vary the number and the position (in terms of the direction perpendicular to the terminal axial direction) of the line-shaped mark exposed on the outer surface of the crimped conductor barrel 16, a quality of the crimp state can be easily evaluated by checking the number and the position. For example, on the assumption that the position of each of the line-shaped marks 17*a* to 17*c* is set so that the intermediate line-shaped mark 17*b* is exposed near the internal end of the conductor barrel 16 when the crimp state is fine as shown in FIG. 3, the crimp of excessively high level hinds the line-shaped mark 17*b* and exposes only the line-shaped mark 17 and shift the line-shaped mark 17*b* inwardly. On contrary, the crimp of excessively low level shifts the line-shaped mark 17*b* outwardly to expose also the line-shaped marks 17*c*. The crimp quality is thus allowed to be evaluated based on the number and the position of the exposed line-shaped line.

Besides, a mark shaped in a straight line extending in a direction parallel to the terminal axial direction such as the line-shaped marks 17*a*, 17*b* and 17*c* according to this embodiment facilitates a check of the position in a direction perpendicular to the direction and further a check of the inclination degree of the conductor barrel to the terminal axial direction (that is, a variation of the crimp level in terms of the terminal axial direction).

Furthermore, providing a plurality of marks different in length corresponding their positions such as the line-shaped marks 17*a*, 17*b* and 17*c* makes it possible to easily identify the marks 17*a*, 17*b* and 17*c*.

In the above embodiments, the check of the position or the shape of the exposed part of the crimp state indicator and the evaluation of the crimp state are allowed either to be done by eyes of an operator or to be automatically done by a device for performing an image pickup of the exposed part and a device for performing an image processing of the data.

Besides, the present invention can be also applied to a crimped terminal provided with a plurality of pairs of conductor barrels at respective positions aligned in a front-to-rear direction. In this case, the crimp state indicator may be provided to only a part of the pairs of the barrels.

The present invention thus provides a crimp terminal having conductor barrels to be crimped onto a conductor at an end of an electric wire and allowing a quality of the crimp of the conductor barrels onto the conductor, especially a level of the crimp, to be easily evaluated, and a method of manufacturing a terminal-provided wire comprising the crimp terminal.

Specifically, a crimp terminal according to the present invention has a conductor crimp portion adapted to be crimped onto an end of an electric wire having a conductor exposed in the end, the conductor crimp portion including a basal portion extending in a terminal axial direction of the crimp terminal and a pair of conductor barrels extending oppositely in directions perpendicular to the terminal axial direction and being adapted to be bent to be so crimped onto the conductor as to embrace the conductor; each of the conductor barrels has an outer surface provided with a crimp state indicator so shaped that a position of an internal end of an outwardly exposed part of the crimp state indicator is varied, in the terminal axial direction, corresponding to a crimp level of the conductor barrels.

As to the conductor barrels, "extending oppositely in directions perpendicular to the terminal axial direction" is not intended to distinctly limit the specific shapes and the longitudinal direction of the conductor barrels, but intended to encompass a conductor barrel whose longitudinal direction is inclined relative to the direction perpendicular to the terminal axial direction or whose axial size is larger than the size in the direction perpendicular to the axial direction.

Besides, as to the crimp state indicator, "an internal end of an outwardly exposed part" means the most internal point in the exposed part, that is, the point closest to the other conductor barrel.

In the crimp terminal, the crimp state indicator is provided to the conductor barrel and the position of the internal end of the part of the crimp state indicator which part is exposed following the crimp of the conductor barrel is varied in the terminal axial direction corresponding to the crimp level of the conductor barrel; therefore, the crimp state of the conductor barrels, especially a failure/no-failure of the crimp level, can be easily evaluated based on the position of the internal end.

More specifically, the crimp indicator provided to each of the conductor barrels preferably includes a line-shaped mark inclined to the terminal axial direction in a direction perpendicular to the terminal axial direction. This mark, while having a simple shape, can function as a indicator showing a crimp level because the position of the internal end of a part exposed following the crimp varies, in the terminal axial direction, corresponding to the crimp level of the conductor barrels.

The crimp state indicators provided to the respective conductor barrels are preferably of symmetric configuration about a center axis of the crimp terminal. This configuration allows a failure/no-failure of a balance of the crimp states of the conductor barrels to be easily evaluated based on a difference between the positions, in terms of the terminal axial direction, of the crimp state indicator.

For example, the crimp state indicator provided to each of the conductor barrels is preferably formed of a groove depressed in the outer surface of the conductor barrel.

The present invention also provides a method for manufacturing a terminal-provided wire having an electric wire including a conductor exposed in an end thereof and a crimp terminal crimped onto the end, the method including: a step of forming the crimp terminal described above; a crimping step of bending the conductor barrels of the formed crimp terminal to crimp the conductor barrels onto the conductor from outside in the end of the electric wire; and a step of determining a failure/no-failure of a crimp state in the terminal-provided wire based on a position of an internal end of the crimp state indicator, on the conductor barrel, exposed following the crimping.

The crimp terminal according to the present invention may be provided with another crimp state indicator, in the outer surface of each of the conductor barrels, including a plurality of marks spaced in a direction perpendicular to the terminal axial direction, instead of the crimp state indicator having the above-mentioned shape or in addition thereto.

In this crimp terminal, the number and the positions of the marks, on the conductor barrels, exposed following the crimp of the conductor barrels are so varied corresponding to the crimp levels of the conductor barrels that the quality of the crimp, especially the crimp levels, can be easily evaluated.

Specifically, each of the marks is preferably of a line shape extending in a direction parallel to the terminal axial direction. Thus shaped mark, extending in a direction parallel to the terminal axial direction, allows its position in terms of a direction perpendicular to the terminal axial direction and its inclination degree to the terminal axial direction (that is, a variation in the crimp level in terms of the terminal axial direction) to be easily checked.

Also these crimp state indicators are preferably of symmetric configuration about the center axis of the crimp terminal and are allowed to be formed of grooves depressed in the outer surfaces of the conductor barrels.

The present invention also provides a method of manufacturing a terminal-provided wire having an electric wire including a conductor exposed in an end thereof and a crimp terminal crimped onto the end, the method including: a step of forming a crimp terminal provided with a crimp state indicator including a plurality of marks; a crimping step of bending the conductor barrels of the formed crimp terminal to crimp the conductor barrels onto the conductor from outside in the end of the electric wire; and a step of determining a failure/no failure of a crimp state in the terminal-provided wire based on the number of the marks, on the conductor barrel, exposed following the crimping and respective positions of the marks.

The invention claimed is:

1. A crimp terminal having a conductor crimp portion adapted to be crimped onto an end of an electric wire having a conductor exposed in the end, the conductor crimp portion including a basal portion extending in a terminal axial direction of the crimp terminal and a pair of conductor barrels extending oppositely in directions perpendicular to the terminal axial direction and being adapted to be bent to be crimped onto the conductor so as to embrace the conductor, wherein each of the conductor barrels has an outer surface provided with a crimp state indicator so shaped that a position of an internal end of an outwardly exposed part of the crimp state indicator is varied, in the terminal axial direction, corresponding to a crimp level of the conductor barrels.

2. The crimp terminal according to claim 1, wherein the crimp indicator provided to each of the conductor barrels includes a line-shaped mark inclined to the terminal axial direction in a direction perpendicular to the terminal axial direction.

3. The crimp terminal according to claim 1, wherein the crimp state indicators provided to the respective conductor barrels are of symmetric configuration about a center axis of the crimp terminal.

4. The crimp terminal according to claim 1, wherein the crimp state indicator provided to each of the conductor barrels is formed of a groove depressed in the outer surface of the conductor barrel.

5. A method for manufacturing a terminal-provided wire having an electric wire including a conductor exposed in an end thereof and a crimp terminal crimped onto the end, the method including:

a step of forming the crimp terminal according to claim 1, a crimping step of bending the conductor barrels of the formed crimp terminal to crimp the conductor barrels onto the conductor from outside in the end of the electric wire; and a step of determining a failure/no-failure of a crimp state in the terminal-provided wire based on a position of an internal end of the crimp state indicator, on the conductor barrel, exposed following the crimping.

6. A crimp terminal having a conductor crimp portion adapted to be crimped onto an end of an electric wire having a conductor exposed in the end, the conductor crimp portion including a basal portion extending in a terminal axial direction of the crimp terminal and a pair of conductor barrels extending oppositely in directions perpendicular to the terminal axial direction and being adapted to be bent to be crimped onto the conductor so as to embrace the conductor, wherein each of the conductor barrels has an outer surface provided with a crimp state indicator including a plurality of marks spaced in a direction perpendicular to the terminal axial direction.

7. The crimp terminal according to claim 6, wherein each of the marks is of a line shape extending in a direction parallel to the terminal axial direction.

8. The crimp terminal according to claim 6, wherein the crimp state indicators provided to the respective conductor barrels are of symmetric configuration about a center axis of the crimp terminal.

9. The crimp terminal according to claim 6, wherein the crimp state indicator provided to each of the conductor barrels is formed of a groove depressed in the outer surface of the conductor barrel.

10. A method of manufacturing a terminal-provided wire comprising an electric wire having an end in which a conductor is exposed and a crimp terminal which is crimped to the end, the method comprising:

a terminal forming step of forming the crimp terminal according to claim 6, a crimping step of bending the conductor barrels of the formed crimp terminal to crimp the conductor barrels onto the conductor from outside in the end of the electric wire; and a step of determining a failure/no-failure of a crimp state in the terminal-provided wire based on the number of the marks, on the conductor barrel, exposed following the crimping and respective positions of the marks.

* * * * *